United States Patent [19]

Vrind et al.

[11] Patent Number: 4,669,248

[45] Date of Patent: Jun. 2, 1987

[54] APPARATUS FOR PACKING A ROW OF LIDS AND THE COMPLETED PACKAGE

[75] Inventors: Hendrik C. Vrind; Gerrit H. F. Ter Horst, both of Schalkhaar; Henrik J. Hamer, Nijverdal, all of Netherlands

[73] Assignee: Thomassen & Drijver-Verblifa N.V., Deventer, Netherlands

[21] Appl. No.: 867,569

[22] Filed: May 28, 1986

[30] Foreign Application Priority Data

May 28, 1985 [NL] Netherlands ..... 8501520

[51] Int. Cl.[4] ..... B65B 11/22; B65B 11/26

[52] U.S. Cl. ..... 53/229; 53/202

[58] Field of Search ..... 53/228, 229, 154, 532, 53/202

[56] References Cited

U.S. PATENT DOCUMENTS

| | | | |
|---|---|---|---|
| 2,332,316 | 10/1943 | Hexter et al. | 53/202 X |
| 2,335,750 | 11/1943 | Fincke et al. | 53/202 |
| 2,936,557 | 5/1960 | Fay | 53/202 X |
| 3,236,024 | 2/1966 | Bradley et al. | 53/229 X |
| 3,513,622 | 5/1970 | Timmerbeil | 53/229 X |
| 4,102,112 | 7/1978 | Rose | 53/228 |

*Primary Examiner*—Horace M. Culver
*Attorney, Agent, or Firm*—John P. Snyder

[57] ABSTRACT

An apparatus is disclosed for packaging a row of mutually coaxially placed disc-shaped lids, in a sheet of packing material, comprising successively in the direction of progress of packaging: a feeding station for the row of members; a wrapping station for wrapping the row of members in the sheet; a folding station for the folding of the wrapped sheet; a sticking station for the sticking of the folded flaps to the package; further transportation members for transportation of the row of members; and a unit for supplying the packing material, situated between the feeding station and the wrapping station, characterized in that the feeding station is provided with at least two feeding units for the lids, and with a feeding table which is slidable between each of the two feeding units and the wrapping station. Preferably the transportation unit in the respective feeding unit detaches a row of lids from a given accreting row of lids, transports this detached row at increased speed through a certain distance into an intermediate station situated in the feeding unit, and brings it from the intermediate station to in front of the pusher.

18 Claims, 15 Drawing Figures

APPARATUS FOR PACKING A ROW OF LIDS AND THE COMPLETED PACKAGE

The present invention relates to an apparatus such as described in the heading of claim 1.

An apparatus of the kind is known. The invention has for its aim to make this known apparatus suitable for the processing of continuously accreting rows of lids offered up by a plurality of lid-fabricating machines. Additional requirements are (1) that the production of lids may not be interrupted by for instance temporarily blocking the growing row of lids; (2) that lids of different manufacturing machines are not intermingled, and accordingly each package contains solely lids which were manufactured on one machine, and said package can be coded for that machine. This is achieved in accordance with the invention by providing the input station with at least two rows of feeding units for the members and with a feeding table which is slidable between each of the two feeding units and the wrapping station. Since to two feeding units are not combined to form a single common feeding unit, the machine is prevented from acquiring too great a length. Moreover, with the use of adequate controlling means the packaging can take place independently of the production speed of each of the memberfabricating machines.

In order to prevent a feeding unit from becoming blocked with members to be packed, it is preferred that the transportation unit in the respective feeding unit detaches from a given accreting row of members a row of members with a certain length, transports this detached row at increased speed through a certain distance into an intermediate station situated in the feeding unit and brings it from the intermediate station to in front of the pusher. Additionally to the machine production time shortened, due to a shorter transport length from intermediate station to feed station.

The row of members is wrapped in the sheet of packing material. Wrapping means in this case that the packing material is formed into U-shape around the row of members. In order to adjust the lateral edges of the sheet wrapped around the row, the supplying unit for packing material is according to the invention moveable with respect to a surface through the packaging apparatus, and/or there is mounted on the side of the surface opposite to the supply unit a packing-material detector which is movable with respect to this surface.

From the state of the art there is known a cutting unit which consists of two shearing blades which extend over the entire breadth of the strip-shaped packing material. These shearing blades have the disadvantage that when used for a relatively wide strip-shaped material they bend, as a result of which the cutting action diminishes and tearing can occur. Moreover, after execution of a cutting operation the cutting blades have to be moved away from each other once again, in order to free the passage for the strip-shaped material.

Preferably a cutting unit is used which consists of a blade which extends over the whole breadth of the strip of packing material, and cooperating with it, a knife transversely displaceable over the strip, the displaceable knife being preferentially a cutting disc rotating during displacement.

For the wrapping station means are provided for setting the breadth of the lateral lengthwise edges of the packing material which is formed around the row of members. The wrapping station comprises thereto a wrapping baseplate, and a wrapping plate which is secured against tilting, at a distance a above the baseplate, having spring means exerting a force in the direction of the base plate, it is possible to avoid slippage of paper occurring during wrapping. The paper slippage is adjustable by adjustment of the spring pressure.

The folding station comprises a longitudinal folding unit with a folding baseplate, a locking plate fitted tiltably at distance b above the baseplate, and reciprocally movable cooperating folding blades. If, as is preferred, the folding blade referred to as the bottom folder, which forms the wrapper edge to be laid against the row of members, is provided with a thrust member which is slidably guided along the surface of the bottom folder facing the row of members, the closeness of fit with which the wrapper is placed around the row of members can be adjusted. In order to avoid damage to the bottom folder, it is preferable that the bottom folder is slidably guided in a folding-blade frame.

For the formation of the end fold, the folding station comprises an end folding unit with at least one end folder which is movable relative to an end of a wrapped row of members which has arrived in the folding station. If the end folder is reciprocally movable between the folding station and the wrapping station, the end folder can brush along the end of the row of members and thereby form a single fold, since on entry to the folding station the wrapper has a U-form. On the returning movement of the end folder, after the wrapper has completely enclosed the row of members, the lateral free ends of the packaging are fitted around the members and the next fold is formed. The end fold can be completed if downstream of the trajectory of the end folder there are guidance means fitted, which bring together the wrapping flaps which stand out from the end of the wrapped row of members, said wrapping flaps being perferentially attached to the body of the packaging by means of an adhesive strip in a sticking station.

The invention relates to the completed packaging.

The stated and other characteristics will be elucidated in relation to a number of embodiments of the packaging apparatus according to the invention, with reference to the accompaning drawings. In the drawings:

FIG. 1 shows a prespective partly cut-away view of the packaging apparatus in accordance with the invention;

FIGS. 2 to 6 each show a view of a cross-section of the wrapping, folding, and sticking station with the various stations in successive states of packing progress;

Figure 1:
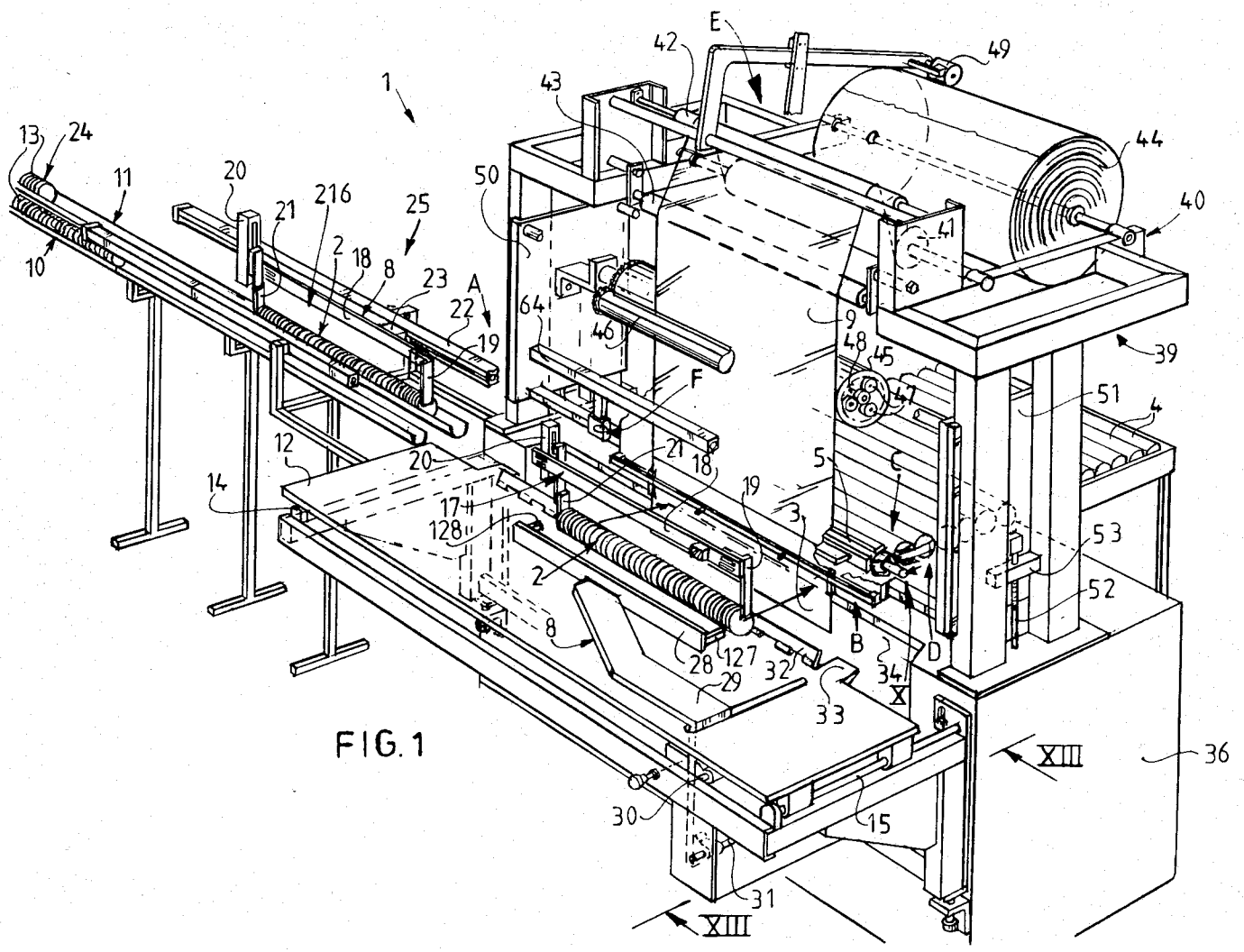
Figure 2:
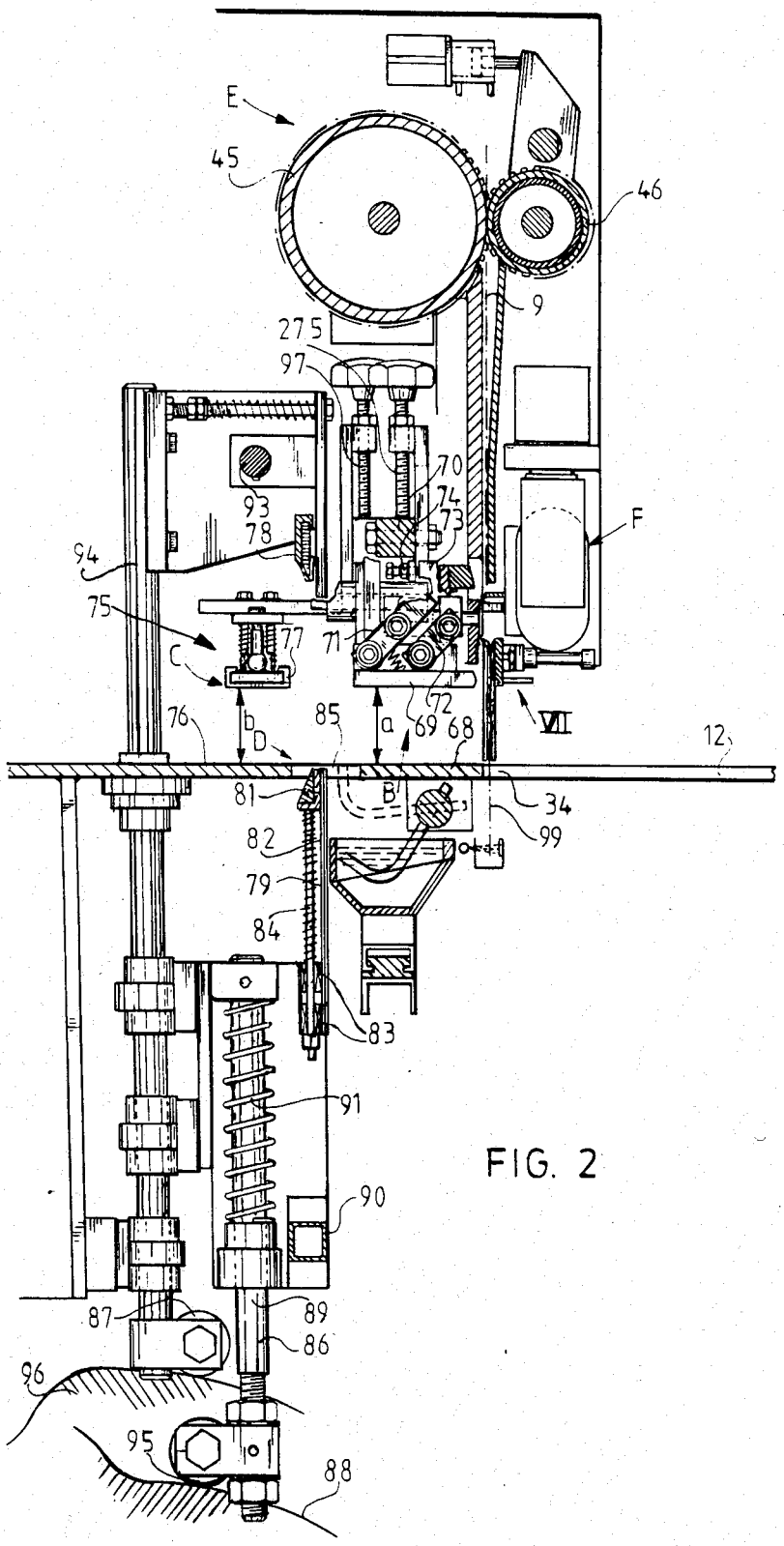
Figure 3:
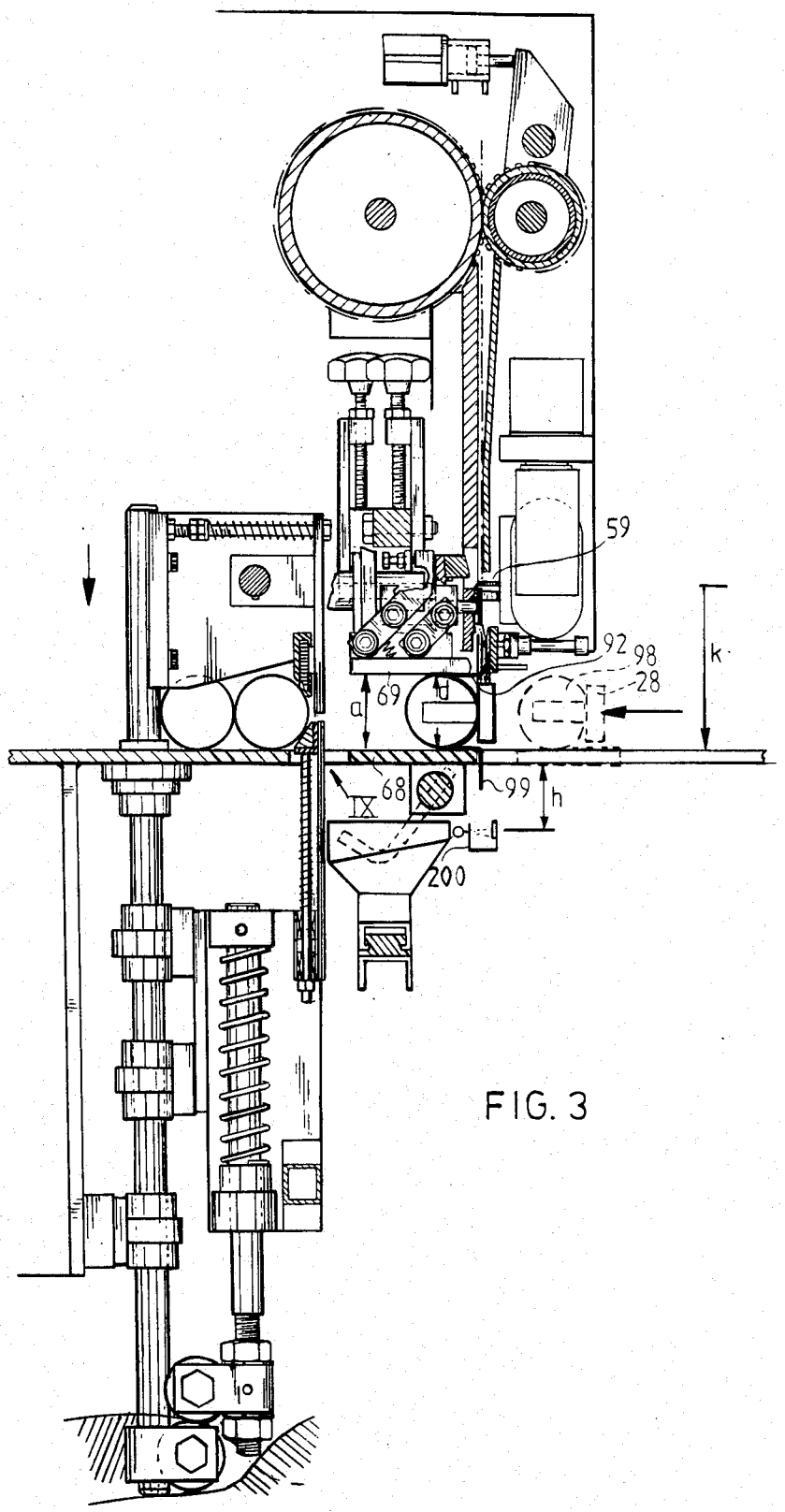

FIG. 1 shows in perspective packaging apparatus 1 in accordance with the invention for the packaging of row 2 of mutually coaxially placed disc-shaped end walls or lids 13, in sheet 3 of packing material, to form elongated package 4.

Apparatus 1 comprises successively in the direction of packaging progress: feeding station A for rows of members 2; wrapping station B for wrapping the row of members in sheet 3; folding station C for the folding of wrapped sheet 5; and sticking station D for the sticking of the folded portions to the package. Additionally, apparatus 1 comprises transportation means 8 for the transportation of row 2. Further, there is situated between feeding station A and wrapping station B a supply unit E for strip-shaped packing material 9. Finally there is present cutting unit F for the cutting of packing material 9 into sheets 3.

Feeding station A is equipped with two feeding units 10 and 11, which have a chute-form, and each is connected upstream to a machine which fabricates members 13. Each feeding unit 10 and 11 emerges at feeding table 12, which is guided in guides 14 and 15 and is slidable between each of the two feeding units 10 and 11 and wrapping station B, under influence of pneumatic cylinder 16.

Transportation means 8 comprises, for each feeding unit 10 and 11, transportation unit 16 and 17 respectively. Each transportation unit 16 and 17 comprises frame 18, strip 19 fastened downstream thereof and, situated upstream, separating member 21 which is movable up and down with the help of cylinder 20. Frame 18 is firmly attached to piston 23, which is guided in cylinder 22.

With the aid of transportation unit 16, a row 2 with a specific length can be separated from accreting row 24 with the aid of separating member 21, whereafter separated row 2 is transported at a speed greater than the accretion velocity of row 24 to intermediate station 25, directly at the exit of each feeding unit 10 and 11.

Figure 13:
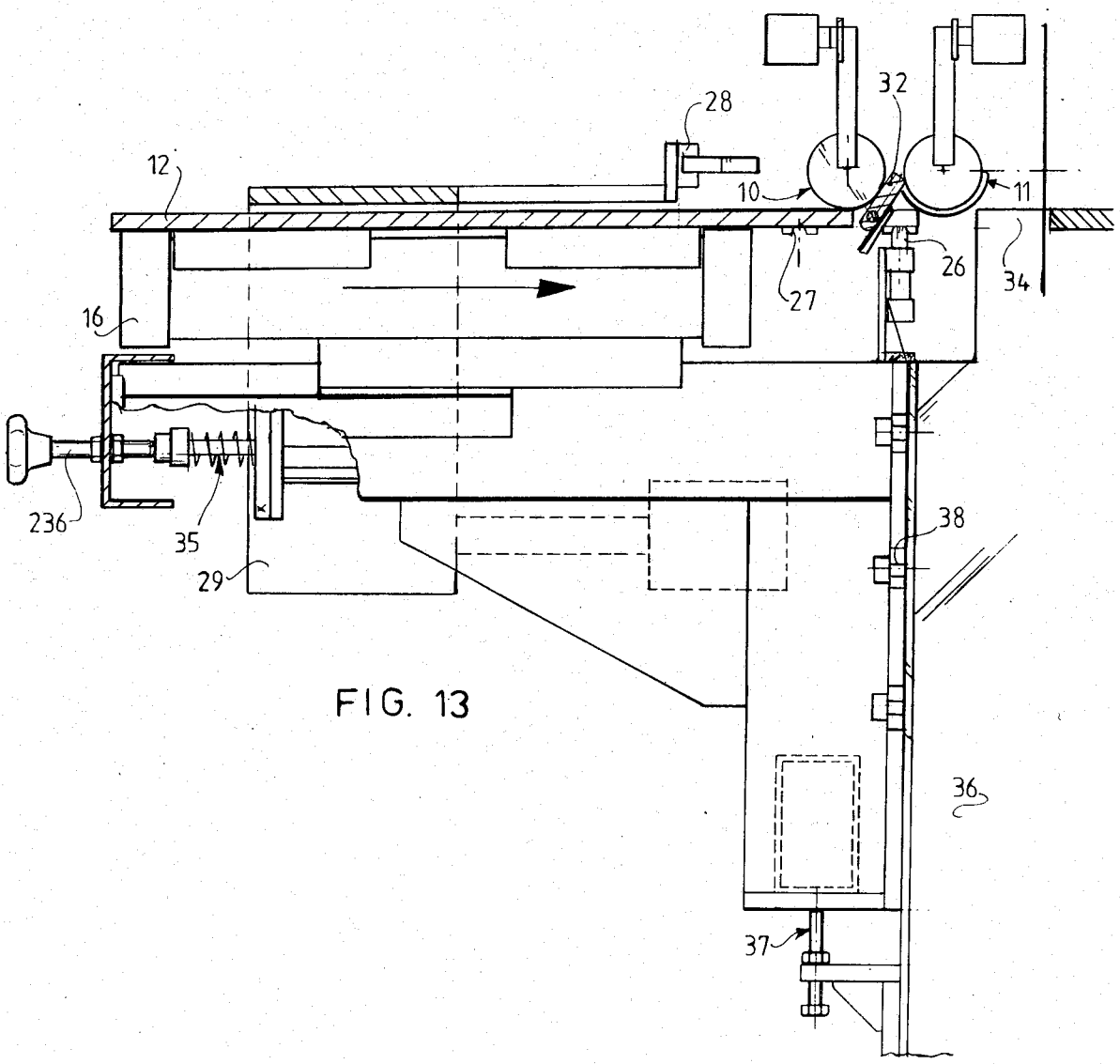
FIG. 13 shows a cross-section on the line XIII—XIII of FIG. 1.
Figure 14:
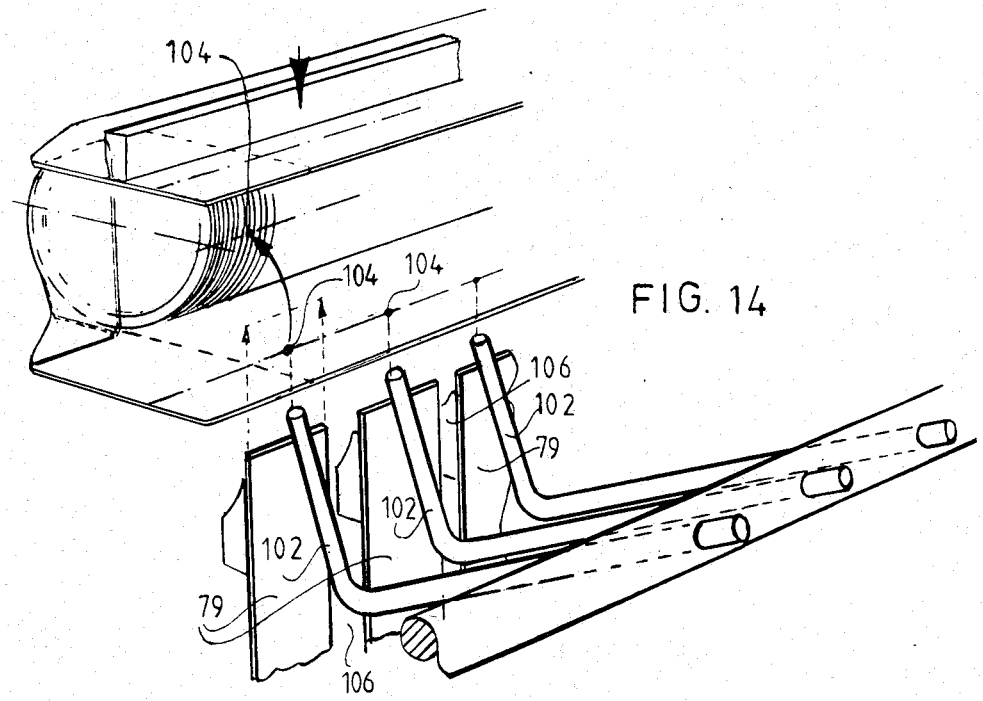
FIG. 14 shows a perspective view in the direction of arrow XVI.

After feeding table 12 is brought in front of the feeding unit with the aid of cylinder 16, and is positioned there in relation to feeding unit 10 with the aid of positioning pin 26, transportation unit 17 transports row 2 to a position in front of pusher 28, which is reciprocally movable over the feeding table (see FIG. 13).

Pusher 28 is guided on feeding table 12, via hook-shaped arm 29, by means of guide-rails 30 and 31. Thus pusher 28 moves when feeding table 12 moves.

During transportation of row 2 to in front of pusher 28, the row is guided with the aid of guide 32 which is fitted along edge 33, bordering wrapping station B. Guide 32 is pivotable between a tilted position, shown in FIG. 1 and 15, and a position in which the guide is situated in the plane of the feeding table. In this latter position the guide partially bridges gap 34, which is situated between feeding station A and wrapping station B.

The motion of pusher 28 of wrapping station B is limited by shock-absorber unit 35, with which the stroke of pusher 28 is also adjustable, for example in accordance with the diameter of members 13, with the aid of adjusting screw 236.

Feeding table 12, together with its guiding means, is detachably fastened to supporting frame 36 of apparatus 1. With the aid of adjusting means 37 and 38, feeding station A can be aligned with respect to wrapping station B.

Supply unit E for strip-shaped packing material 9 comprises tower 39 which is supported over frame 36. Tower 39 comprises seat 40 for rolls 41 and 44 of packing material. Strip 9 passes over roller 42 and roller 43, and is then fed between drum roller 45 and cooperating pressure roller 46. Drum roller 45 is provided with an internally fitted motor which drives, via gear-wheels 47, shaft 48 which is coupled to drum 48. Since strip 9 passes over roller 42, as much tension as possible, for example curling tension, is removed from strip 9.

With the aid of coding unit 49, a code is marked on strip 9 and thus on elongated package 4. The applied code identifies, for example, the apparatus 1. Rollers 45 and 46 are rotatably fastened to slides 50 and 51, which are guided along tower 39, which slides are, with the aid of in crossmember 53 threaded spindle 52, adjustable in heigth with respect to feeding table 12 and work table 54 which lies in the same plane. Each slide 50 and 51 is provided with a spindle 52.

Figure 7:
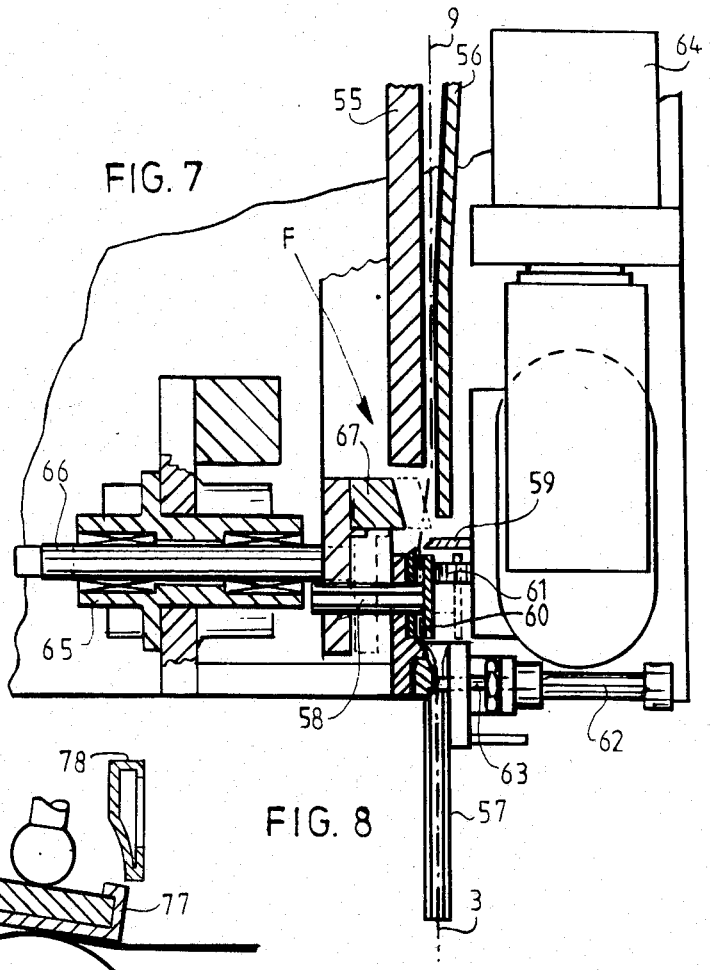
FIG. 7 shows detail VII of FIG. 2 on a larger scale.
Figure 8:
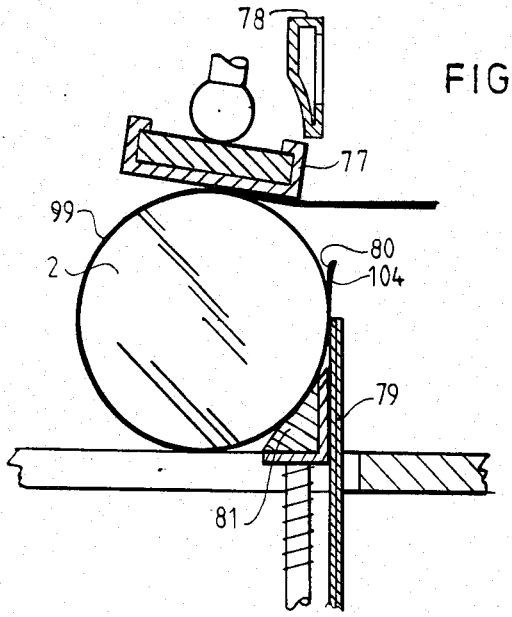
FIGS. 8 and 9 show details VII and IX of FIG. 6 and FIG. 3 respectively on a larger scale.
Figure 9:
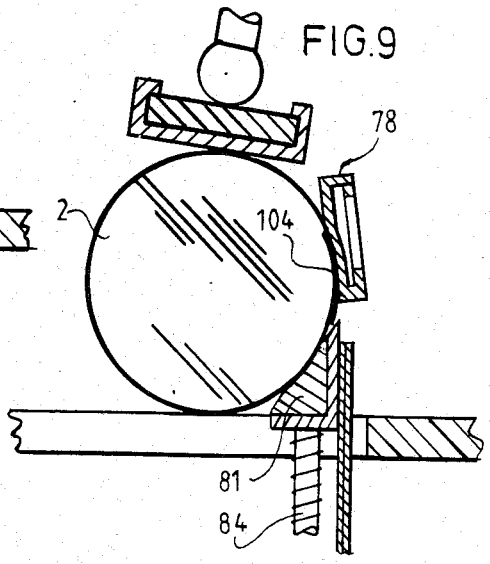

FIG. 7 shows in more detail cutting unit F, for cutting into sheets 3 strip of packing material 9, which passes between slot-forming plates 55 and 56. Cut sheet 3 is guided by its longitudinal edges in U-shaped guidance strips 57. The cutting unit consists of stationary cutting blade 58, which extends over the entire breadth of strip 9 of packing material, and, cooperating therewith, disc-shaped knife 9 which is transversely displaceable over strip 9. Knife 59 is rotationally driven during displacement by rollers 61, which run over paper pressing frame 60. The sheet is clamped after cutting with the aid of rams 63, which are actuated by pressure cylinder 62. Rotating knife 59 is displaceably guided on pressure cylinder 64 and moves between tow positions located on opposite sides of strip 9 (see FIG. 1), such that paper pressure frame 60 is displaceable between the positions indicated in FIG. 7 by solid and broken lines respectively. Nose 67, slidably journalled in piece 65 by means of rod 66, can be inserted into the passage between plates 55 and 56, in order so to lead strip 9 in its passage through cutting unit F, that the strip travels between stationary knife 58 and paper pressing frame 60, and is led downstream in lateral guides 57.

FIG. 2 to 6, 8 and 9 show in more detail wrapping station B, folding station C and part of sticking station D.

Wrapping station B, lying in line with feed table 12, comprises wrapping baseplate 68, and wrapping plate 69 which is fitted at distance a above the baseplate. Wrapping plate 69 is suspended from beam 70, and locked against tilting out of the horizontal position, by means of links 71 and 72, which are arranged in a parallelepiped. Link 71 is provided with nose 73 which cooperates with adjustable stop 74. In this way a lowest position of wrapping plate 69 is set, and when necessary adjustable, using set-screw 275. Springs force wrapping plate 69 into its lowest position.

Folding station C comprises longitudinal folding unit 75 with folding baseplate 76 and, at distance b above baseplate 76, tiltably fitted locking plate 77 and reciprocally cooperating folding blades 78 and 79. Folding blade 79, called bottom folder 79, forms the wrapper edge to be placed in contact with row 2, and is provided with a wedge-shaped thrust member 81 which is slidably guided along that surface 82 of bottom folder 79 which faces towards row of members 2, with the aid of rod 84, slidably journalled in bearing 83. The bottom folder can be moved through slot 85, which is situated in folding baseplate 76, with the aid of frame 86, which by means of curve follower 87 is supported by, and rolls over, curve 88. In order to prevent damage to bottom folder 79 should the path of movement of bottom folder 79 become blocked, the bottom folder is fitted to bottom folder frame 90, which is guided on rod 89, while spring 91 continuously forces frame 90 to its lowest position.

In a similar manner, folding blade 78, called the top folder, for forming the overlapping wrapper edge 92, is fitted pivotably around shaft 93 to frame 94, which via another curve follower 95 rolls over, and is supported by, curve 96. Since curves 88 and 96 are rotatbly fitted around a common axis, the motion of the two folding blades 78 and 79 is synchronized.

With the aid of adjuster pin 97, distance b between locking plate 77 and folding baseplate 76 is adjustable.

FIG. 3 to 6 and 8 and 9 show the operation of wrapping station B and longitudinal folding unit 75.

With the aid of pusher 28, a row 98 is pushed into hanging sheet 99 and brought under wrapping plate 69. During this movement, rams 63 are deactivated. Distance a is less than diameter d of members 13, so that when row 98 is brought under plate 69, sheet 99 can not become displaced relative thereto. The length of wrapper edge 80 is dependant on height h between detector 200 and the underside of wrapping baseplate 68. The length of wrapper edge 92 is dependant on height k between cutter 59 and wrapping baseplate 68, height k being adjustable by means of spindle 52 (FIG. 1).

Figure 4:
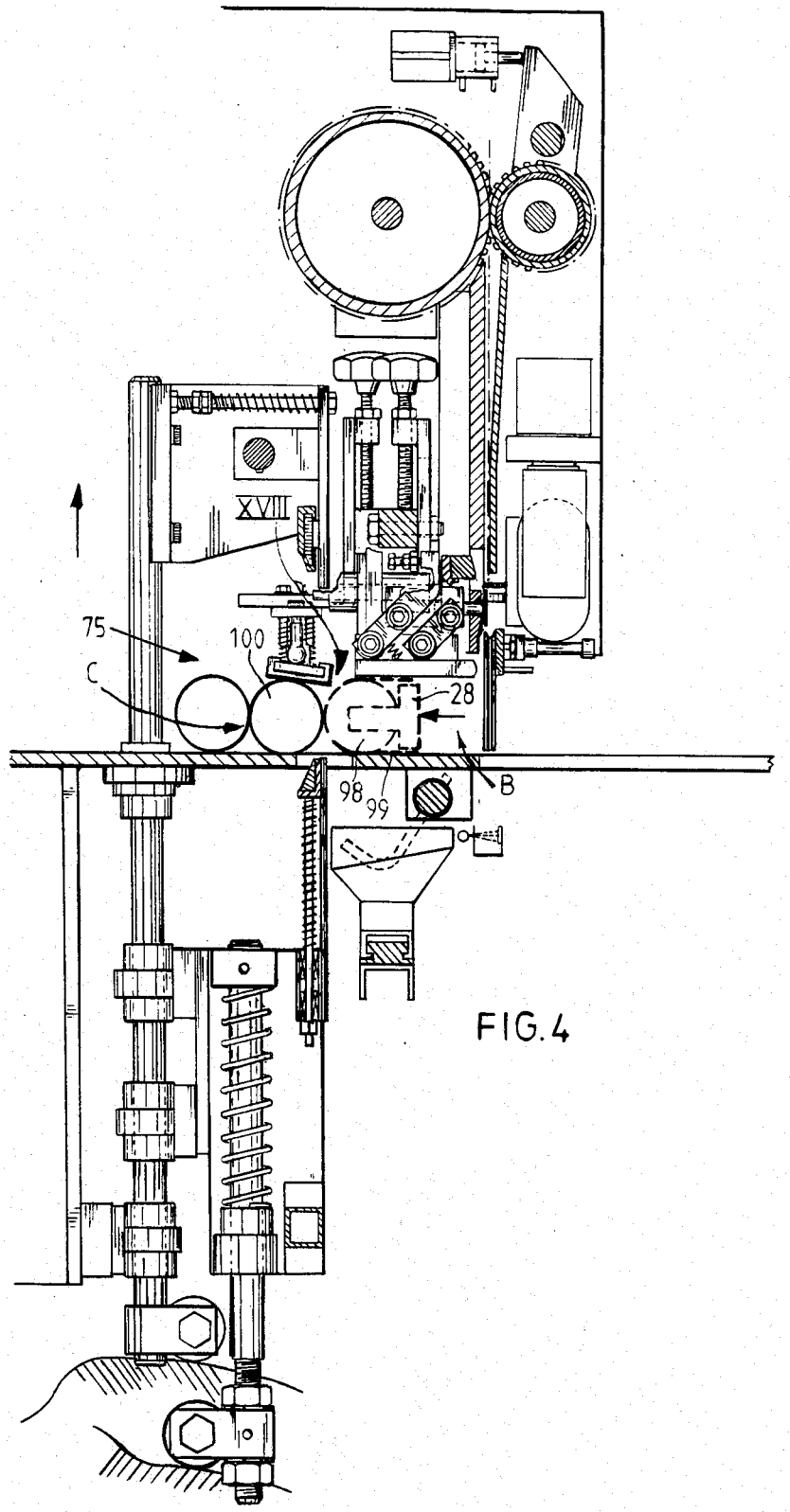

FIG. 4 reveals that the pusher pushes row 98 right through wrapping station B into folding station C. Through the wrapping action, sheet 99 is applied in U-form around row 98.

The row 100 which was originally present in folding station C is there handled from out of longitudinal folding unit 75 and end folding unit 101.

Figure 5:
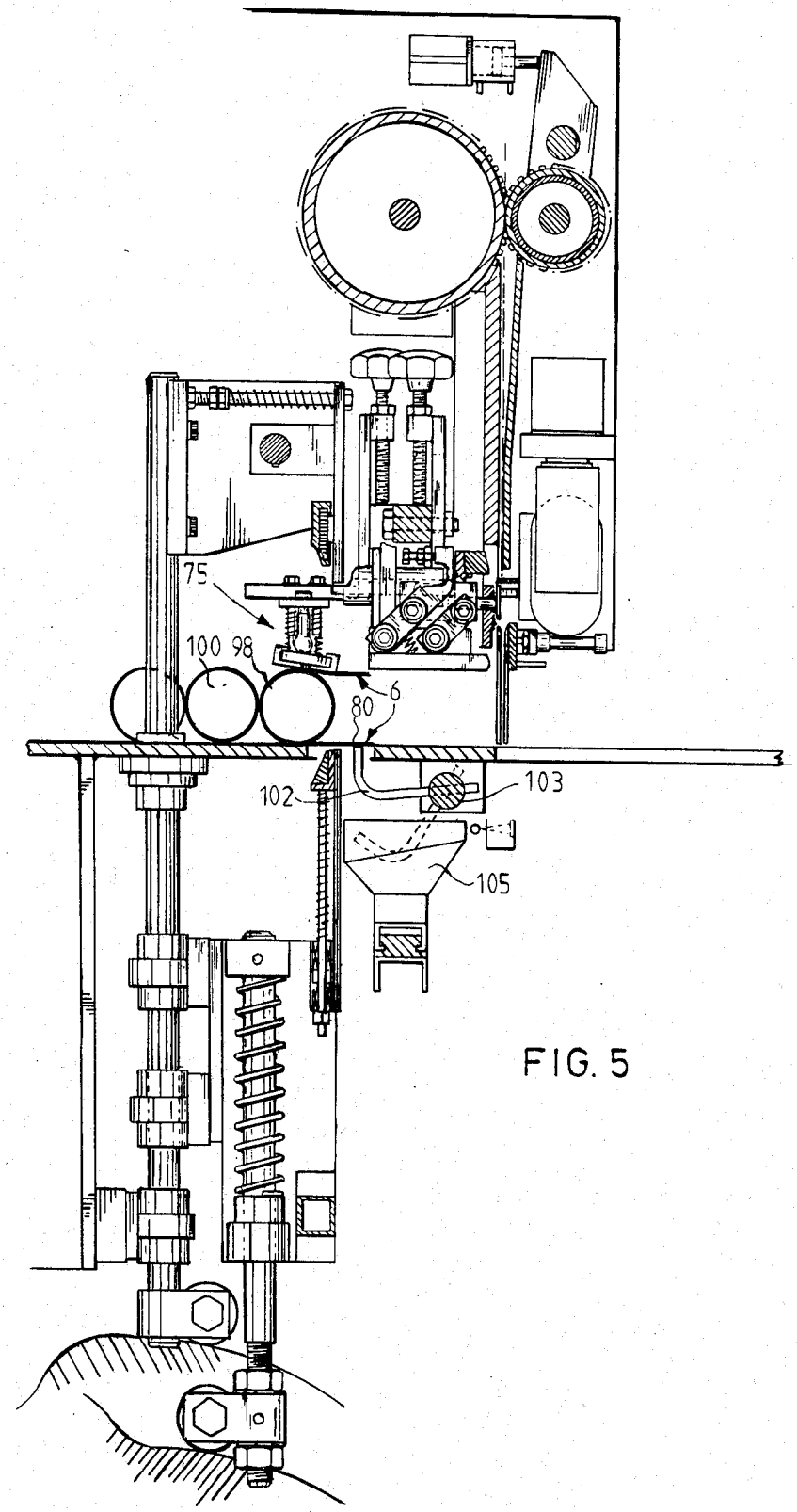
Figure 6:
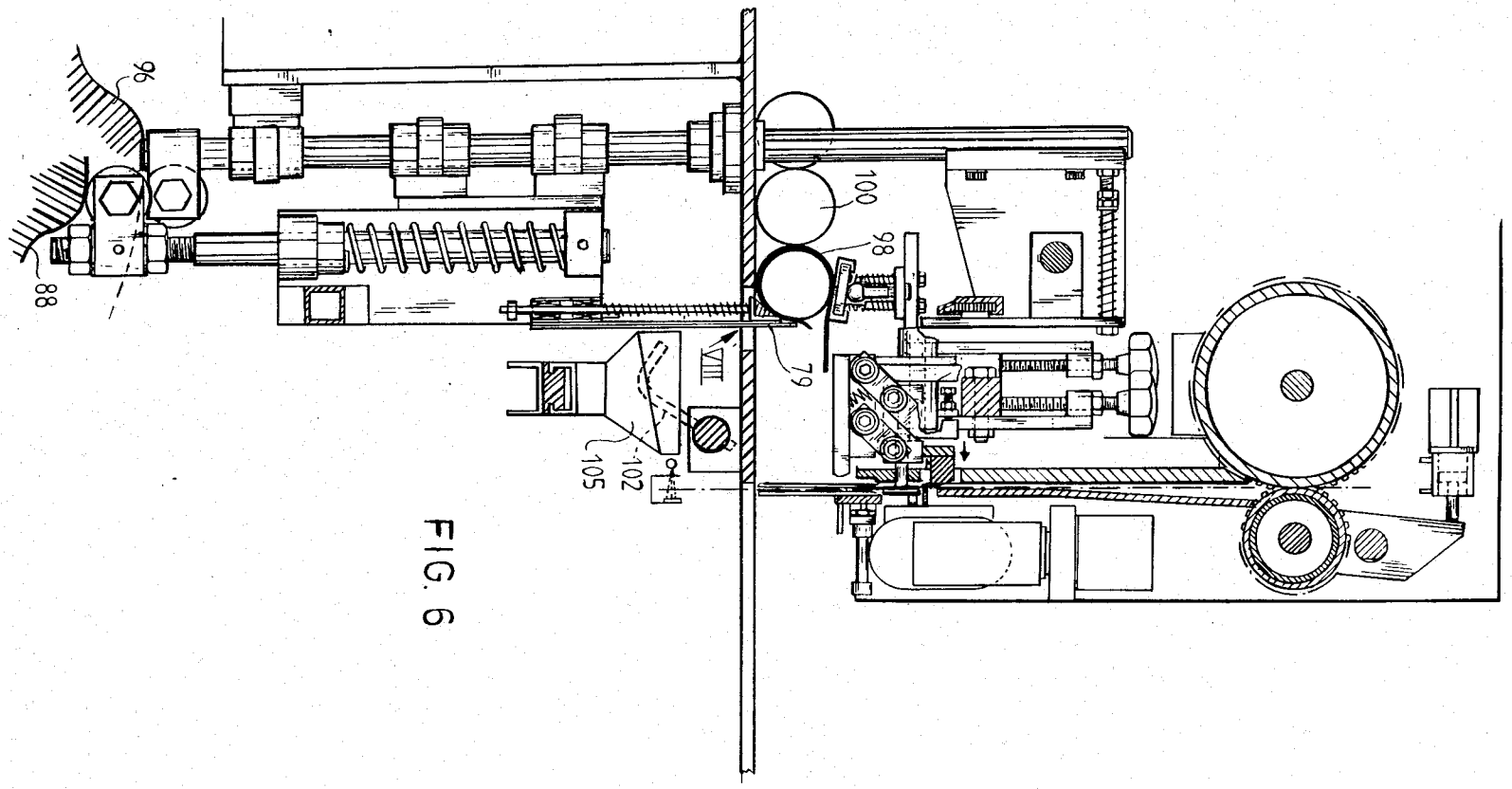

FIG. 5 shows the ultimate position of row 98 in longitudinal folding unit 75. It can be clearly seen that the tilting locking plate 77 prevents a displacement of row 98 against the direction of progression of packaging.

Thereupon, gluing rod 103, which is equipped with gluing fingers 102, is activated (see FIG. 15), whereby wrapper edge 80 is provided with discrete spots of glue over its length. Gluing fingers 102 are movable between a position submerged in glue trough 105, represented by broken lines, and a position where gluing fingers 102 touch wrapper edge 80, represented by solid lines. In order to make this movement possible, bottom folder 79 is provided with a number of slots 106 through which gluing fingers 102 can be moved. Bottom folder 79 can possibly be constructed as a plurality of separate bottom folding members.

After gluing fingers 102 have been swung away into glue trough 105, the curve shaft is activated, whereby curves 88 and 96 rotate. First, bottom folder 79 moves upwards and wrapper edge 80 is laid against row 98. Hereby, thrust member 81 forces wrapper edge 80 upwards so that sheet 99 lies firmly against the row, locking plate 77 preventing a displacement of sheet 99 relative to row 98. Bottom folder 79 moves as fas upwards as a position next to gly points 104. Then top folder 78 moves downwards, whereby overlapping wrapper edge 92 is laid over wrapper edge 80, and transverse edge flaps 80, 92 are thereby pressed together at least at the height of glue spots 104. Top folder 78 takes up thereby a tilting position, which is possible as a consequence of its pivoting around shaft 93.

Although successive packaged rows 98 and 100 have a line of contact at the height of glue points 104, it can be recommended to let the glue harden more quickly, for which purpose top folder 78 may be provided with not-shown hetaing means, with which the hardening time of the glue can be reduced from 6–10 seconds to 2–3 seconds, given a temperature of the top folder of about 100 degrees Celsius.

Figure 10:
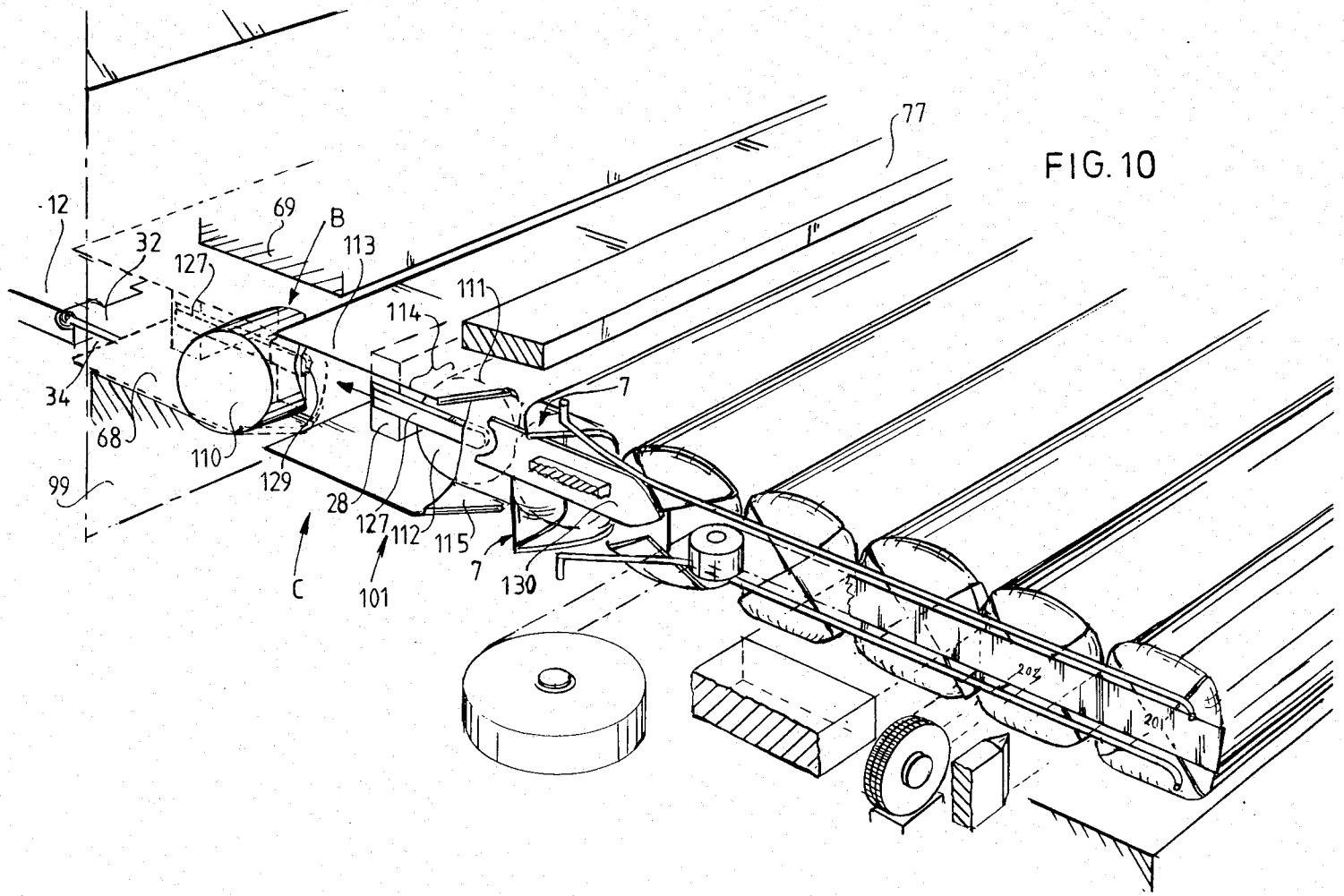
FIGS. 10 to 12 show detail X of FIG. 1 on a larger scale with the folding station in various states.
Figure 11:
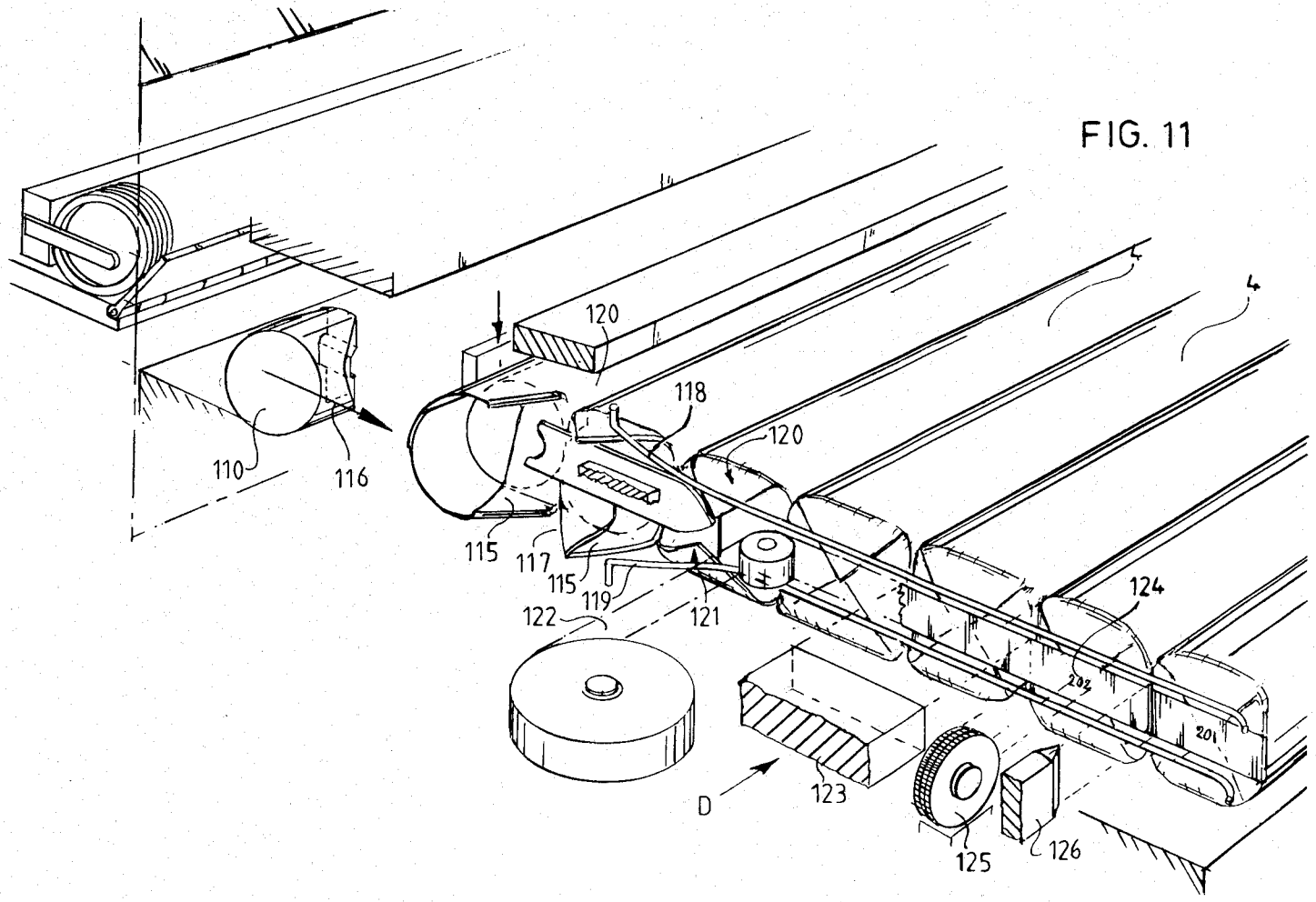
Figure 12:
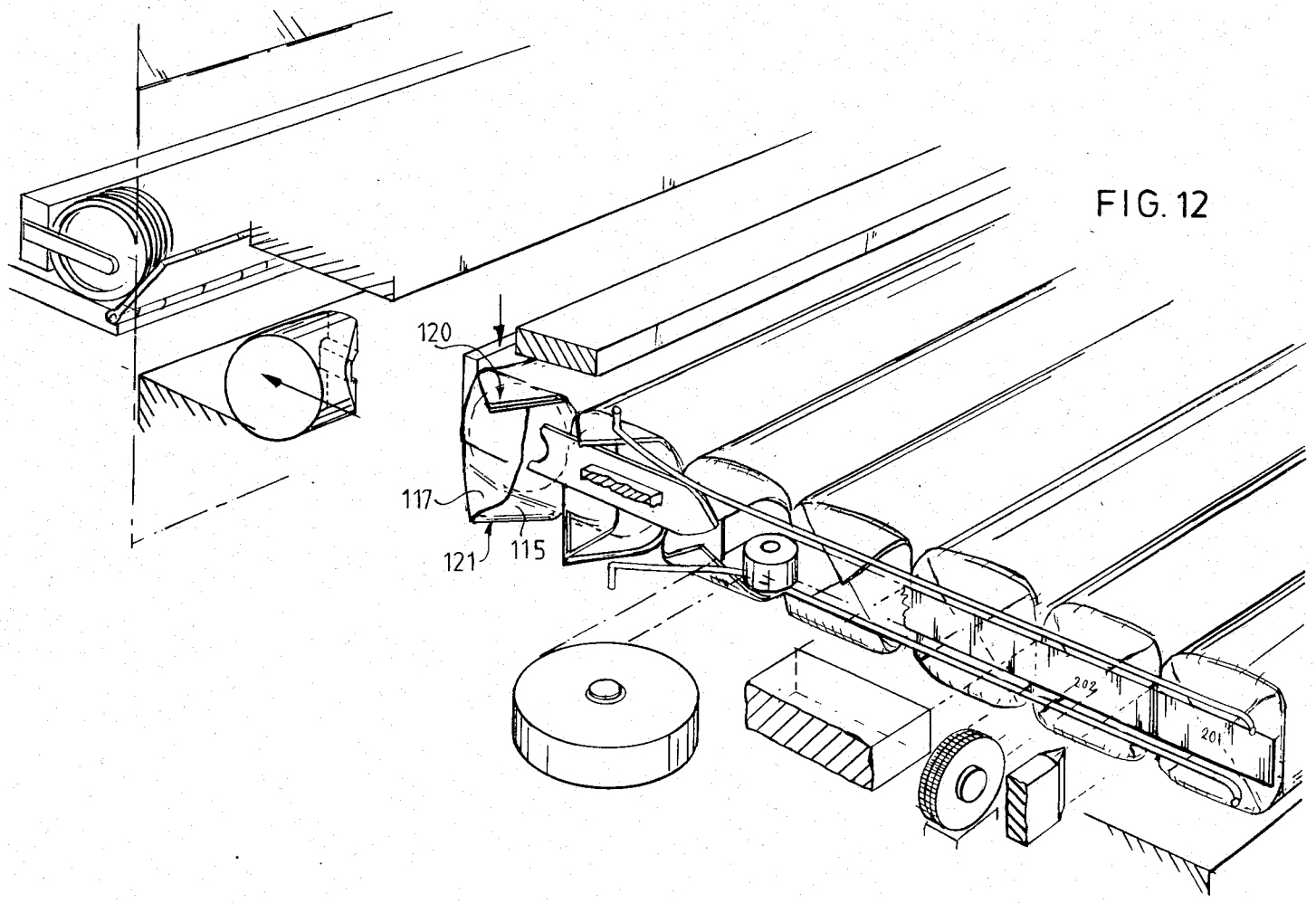

FIG. 10 to 12 show end folding unit 101 of folding station C in more detail. The end folding unit comprises two end folders 110 which move relative to ends 111 of wrapped row of members 112, which arrives from wrapping station B into folding station C. At that moment sheet 113 has a U-shape, so that upon motion of end folder 110 from its position indicated by broken lines to the position indicated by solid lines, there is folded form oversized portion 114 an underfolded part 115. After the pusher is removed from folding station C and the longitudinal seam has been formed by application of the folding blades, end folder 110 is moved in the direction of arrow 116 as fas ar end 111, whereby the other underfold part 115 is formed.

With the aid of guide bars 118 and 119, which are situated downstream of the path of movement of end folder 116, the resulting package flaps 120 and 121 are brought towards each other and, still in this position, are provided in the sticking station with adhesive tape, so that elongated package 4 is formed. With the aid of pressure member 123, adhesive tape 122 is pressed against the package end for an improved attachment, and after the application of code 124 with the aid of printing unit 125, adhesive tape 122 is cut between packages 4 by melting with melting unit 126.

Printing unit 125 prints a code according to whether row 2 was supplied via feeding unit 10 of via feeding unit 11. This is indicated from which machine the members originated.

The pusher 28 can be provided with fingers 127 and 128. Each end folder 110 is provided with a longitudinal groove 129 (see FIG. 12) through which repsective fingers 127, 128 pass during relative motion between, on the one hand, end folder 110 and on the other hand pusher 28. A push frame 130 extending between folding station C and sticking station D, takes over the function of fingers 127 and 128 and prevents a dropping of lids.

Figure 15:
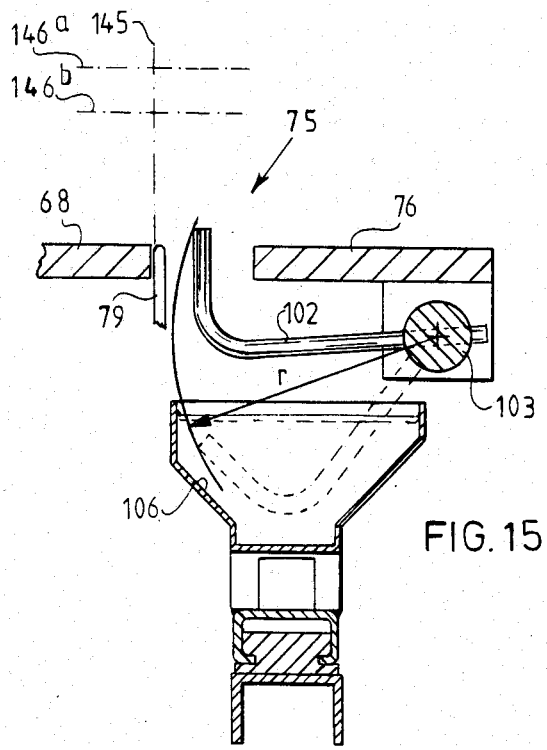
FIG. 15 shows a cross-section of the sticking station.

Finally, FIG. 15 shows a number of critical planes in apparatus 1. Plane 145, which passes through bottom folder 109, determines the stroke of pusher 28 into longitudinal folding unit 75.

Planes **146*a* and 146*b* pass through the longitudinal axis of a row of members. Depending on the distance of these planes 146 from wrapping baseplate 68 and folding baseplate 76, the radius r of each finger 102** is adjusted so that the glue points become positioned at the place where adjacent rows of folded elongated packages are in line-contact with one another. Moreover, foulding of the bottom folder is avoided.

Through the typical end fold formed in accordance with the invention, whereby wrapping flaps 120 and 121 lie over and against underfold 109 and are attached to the package, there exists an end fold which is very resistant to the axially outwards directed force of the members contained in the package under axial pressure.

Adhesive tape 147 used in FIG. 16 is provided with two longitudinal edges 148 and 149 which are free of adhesive 150. Thus end 151 can easily be opened since these longitudinal adges 148 and 149 serve as gripping edges.

Activation and detection means for the transportation units as to control their movement between the various stations are known in the art and therefore not shown.

We claim:

1. An apparatus for packaging a row of mutually coaxially placed disc-shaped members, in a sheet of packing material, comprising succesively in the direction of progress of packaging: a feeding station for the row of members; a wrapping station for wrapping the row of members in the sheet; a folding station for the folding of the wrapped sheet; a sticking station for the sticking of the folded flaps to the package; further, transportation members for transportation of the row of members; and a unit for supplying the packing material, situated between the feeding station and the wrapping station, characterized in that the feeding station is provided with at least two feeding units for the lids, and with a feeding table which is slidable between each of the two feeding units and the wrapping station.

2. An apparatus as claimed in claim 1, characterized in that the transportation means for each feeding unit comprise a transportation unit with which a row of members can be brought from the respective feeding unit to in front of a pusher which is reciprocally movable over the feeding table.

3. An apparatus as claimed in claim 2, characterized in that the pusher is movably guided on the feeding table.

4. An apparatus as claimed in claim 3, characterized in that the transportation unit in the respective feeding unit detaches a row of lids from a given accreting row of lids, transports this detached row at increased speed through a certain distance into an intermediate station situated in the feeding unit, and brings it from the intermediate station to in front of the pusher.

5. An apparatus as claimed in claim 4, characterized in that the feeding table is provided along its edge bordering the wrapping station with a guide-rail which is tiltable between a position in the plane of the feeding table and a position in a plane sloping upwards from the feeding table.

6. An apparatus as claimed in claim 1, characterized in that the unit for supplying packing material supplies strip-shaped packing material and is moveable in relation to a plane through the direction of progress of packaging.

7. An apparatus as claimed in claim 6, characterized in that on the side of the surface facing away from the supplying unit, a packing material detector is mounted which is movable with respect to this surface.

8. An apparatus as claimed in claim 1, characterized in that the supply unit supplies strip-shaped packing material that a cutting unit cuts the packing material in a sheet, and that the cutting unit consists of a cutting blade extending over the entire width of the strip of packing material, and, cooperating therewith, a knife which is transversely displaceable over the strip.

9. An apparatus as claimed in claim 8, characterized in that the displaceable knife is a cutting disc rotating during displacement.

10. An apparatus as claimed in claim 1, characterized in that the wrapping station comprises a wrapping baseplate and a wrapping plate fitted at distance a above the baseplate secured against tilting, and provided with spring means exerting a force in the direction of the baseplate.

11. An apparatus as claimed in claim 10, characterized in that the folding station comprises a longitudinal folding unit with a folding baseplate, a locking plate fitted tiltably at distance b about the baseplate and reciprocally movable cooperating folding blades.

12. An apparatus as claimed in claim 11, characterized in that the bottom folder is slidably guided in a foldingblade frame.

13. An apparatus as claimed in claim 1, characterized in that the folding station comprises an end folding unit with at least one end folder which is relatively movable along an extremity of wrapped row of members which has arrived in the wrapping station.

14. An apparatus as claimed in claim 13, charaterized in that the end folder is reciprocally movable between the folding station and the wrapping station.

15. An apparatus as claimed in claim 14, characterized by a sticking station wherein the package flaps are attached to the body of the package with an adhesive strip.

16. An apparatus as claimed in claim 15, characterized in that the adhesive strip is provided with at least one adhesive-free longitudinal edge.

17. An apparatus for packaging successive rows of lids each in a sheet of packing material, comprising at least two feeding units disposed adjacent each other and individually receiving lids in accumulating fashion, a wrapping station disposed beyond said feeding units for wrapping the sheet around a row of lids, a feeding table adjacent said wrapping station, transportation means for transporting a row of lids from one of the feeding stations to a position on said feeding table spaced from said wrapping station, and means for moving said feeding table between a positon receiving a row of lids from either of said feeding stations and a position delivering such row of lids to the wrapping station.

18. An apparatus for packaging successive rows of lids each in a sheet of packing material, comprising at least two feeding units disposed adjacent each other and individually receiving lids in accumulating fashion, a wrapping station disposed beyond said feeding units for wrapping the sheet around a row of lids, a feeding table spaced from said wrapping station, transportation means for transporting a row of lids from one of the feeding stations to a position on said feeding table opposite said wrapping station, sheet supply means for presenting the sheet in curtain-like form within the space between said feeding table and said wrapping station, said feeding table including means for moving said feeding table toward said wrapping station while pushing said row of lids thereon past said curtain to initiate wrapping of the sheet therearound.

* * * * *